US007000771B2

(12) United States Patent
Kwong

(10) Patent No.: US 7,000,771 B2
(45) Date of Patent: Feb. 21, 2006

(54) VERSATILE GIFT BOX

(76) Inventor: Kwan Wing Kwong, Rm 2022, 20/F., Landmark North., 39 Lung Sum Ave, Sheung Shui, Hong Kong, SeungShui (CN)

( * ) Notice: Subject to any disclaimer, the term of this patent is extended or adjusted under 35 U.S.C. 154(b) by 235 days.

(21) Appl. No.: 10/356,511

(22) Filed: Feb. 3, 2003

(65) Prior Publication Data

US 2004/0149622 A1 Aug. 5, 2004

(51) Int. Cl.
*B65D 71/00* (2006.01)

(52) U.S. Cl. ..... 206/575; 206/497; 229/87.19; 229/116.5; 229/923

(58) Field of Classification Search ..... 206/223, 206/232, 497, 575, 751, 45.2, 45.21, 45.28, 206/45.29; 229/87.19, 922, 923, 116.1, 116.5, 229/125.22, 125.38
See application file for complete search history.

(56) References Cited

U.S. PATENT DOCUMENTS 4,699,312 A 10/1987 Owen
5,060,793 A * 10/1991 Hyun et al. ..... 206/232
5,193,675 A * 3/1993 Otis ..... 206/232
5,251,759 A * 10/1993 Gannon et al. ..... 206/575
5,490,597 A * 2/1996 Schluger ..... 206/575
5,695,066 A * 12/1997 Bartlett ..... 206/575
5,950,820 A * 9/1999 Heinze, IIII ..... 206/232
6,220,440 B1 * 4/2001 Singerman ..... 206/575
6,234,308 B1 * 5/2001 Saffron et al. ..... 206/316.2

FOREIGN PATENT DOCUMENTS

| | | |
|---|---|---|
| CA | 289528 | 7/1929 |
| CA | 1118734 | 2/1982 |
| CA | 1226563 | 9/1987 |

* cited by examiner

*Primary Examiner*—Luan K. Bui
(74) *Attorney, Agent, or Firm*—Rabin & Berdo, P.C.

(57) ABSTRACT

A carton which may be ideally used as a gift box comprises a folded carton contained within the lid which ultimately closes the carton. The carton is formed from a blank having four panels which form the sides of the carton. Four end panels connected to the side panels may be folded together to form a bottom for the carton when in its assembled condition. The entire carton blank is folded to fit inside the lid. A transparent wrap, preferably a shrink wrap encloses the carton and any other wrapping paraphernalia within the lid.

10 Claims, 3 Drawing Sheets

VERSATILE GIFT BOX

BACKGROUND OF THE INVENTION

This invention relates to a carton which when shipped from the manufacturer to its ultimate destination, is in a folded arrangement such that the box or containment vessel is folded so that it may be entirely embraced within the "lid" of the ultimate package. Such boxes are convenient for use as "gift" boxes.

Many "folded cartons" are available in present day commercial establishments. Most folded boxes are shipped in their folded condition and displayed in the folded condition, making it difficult for the consumer to gauge the ultimate size and capacity of the box. Since the dimensions of the box appear on the "knocked down" box it often requires that a consumer have a ruler or tape measure handy to determine the capacity of the assembled carton.

The entire carton will be contained in a transparent or semi-transparent wrap so that the customer may easily determine the size, shape and color of the unassembled gift carton through the transparent wrap. Because the carton itself is stored within the confines of the lid, the informed customer may easily determine (from the size of the lid enclosing the folded carton) the dimensions of the unassembled carton. The customer has merely to hold the gift carton (in its folded condition) up to the article which is to be ultimately housed within the gift carton to gauge whether the folded gift carton will have sufficient capacity to contain the article once the folded box is assembled.

Many prior art gift cartons are manufactured and shipped in their final assembled condition. These prior art gift cartons are usually manufactured from rigid board with the lid in place on the carton. Usually the complete gift box is enclosed in a shrink-wrap plastic enclosure. Additional paraphernalia, such as ribbons, gift tags, decorative stickers, etc. are placed inside the box before the shrink-wrap is applied to the gift carton. The advantage of presenting the ultimate customer with a completely erected rigid gift carton (in a shrink wrap) is that the customer may determine immediately upon seeing the gift carton in its erected form is that it is easy to determine whether the intended gift will fit into the assembled gift carton. The disadvantage is that the shipping and packaging costs associated with the assembled carton can drive the ultimate selling price of the pre-assembled carton out of the range of most consumers.

Thus this type of gift carton will be available only in upscale gift shops where price is not a prime consideration.

PERTINENT PRIOR ART

Canadian Patent 289,528 May 7, 1929

This patent relates to a collapsible metallic box in which the top and bottom components of the box fold around the side walls of the ballot box. The side walls have an accordion like pleat in the middle to permit the side walls to collapse inwardly so that the front and rear walls may be moved into a juxtaposed relationship with only the side walls (being previously folded) being nested therebetween. The top and bottom components may then be folded about the front and rear wall nested package.

The box described herein is metallic in nature and requires metal flanges on some of the wall components in order to deliver its promise of being truly collapsible.

Canadian Patent 1,118,734 Feb. 23, 1982

This is a box manufactured from paperboard and is foldable for shipping and storage in a compact planar configuration. This carton requires considerable manual dexterity to assemble it, and in addition, requires adhesive strips to successfully assemble the box. A strip of adhesive tape is applied across the top of the box, provides additional security for the box.

This box which is paperboard and has a folding capability, has no capability to be ornamented, has no separate lid and lacks the user friendliness of applicant's container wherein the ultimate size of the container is revealed by the lid.

Canadian Patent 1,245,309 Apr. 26, 1983

(Very similar to 1,118,734 above)

Canadian Patent 1,226,563 Sep. 8, 1987

This is a cardboard box which may be folded to form a ballot box. This container is simple in construction and is relatively easy to assemble, but requires a preglued panel to provide a handle and the enclosure requires tabs to engage slots in order to lock the device together. Sealing tape is used to secure the assembled container.

U.S. Pat. Nos. 4,699,312, 4,981,259, 5,610,383, 5,681,113

SUMMARY OF THE INVENTION

This invention thus relates to a method of packaging a folded container entirely within its lid so that the consumer can immediately see the carton, lid, ribbon, bow, gift tags and other wrapping paraphernalia which are displayed within the carton lid in a plastic shrink-wrap. The lid and the contained box assembly are shipped from the manufacturer to a retail purveyor in the compact "knocked-down" condition. Because of this method of packaging and storing, the entire folded carton within the rigid lid, the customer may easily ascertain the length, width and height of the assembled carton without having to open the shrink-wrap covering. The customer only has to hold the package of the lid containing the folded carton up to the intended gift to determine whether the gift will fit into the assembled carton.

The present invention contemplates a combination of a lid further comprising a lid panel, and four lid sides extending generally perpendicularly from the lid panel and being fastened at adjoining end edges thereof, wherein the lid panel is dimensioned such that a space inside the lid has a lid width and a lid length, and the four lid sides are dimensioned such that the space inside the lid has a lid depth; and a folded blank further comprising four main panels each having rectangular panel dimensions such that the folded blank fits, in the space inside the lid, within the lid width and the lid length, and additional panels folded onto the main panels, and wherein the main panels and the additional panels are folded together such that the folded blank fits, into the space inside the lid, within the lid depth, and wherein the folded blank is unfoldable and erectable into a box consisting of four sides each comprising one of the main panels, a bottom comprising the additional panels, and an open top coverable by the lid.

The lid panel and the main panels of the blank may be substantially square, whereby an assembly of the box and the lid is substantially cubical, as is illustrated in the drawing. The additional panels can include four bottom panels which when assembled interlock to form the bottom of the box, as shown in the drawing.

The present invention also contemplates a gift carton comprising a rigid lid, an unassembled gift carton contained, in an unassembled condition, within the rigid lid, wrapping paraphernalia within the rigid lid, and transparent shrink wrap enclosing the lid, the carton, and the wrapping paraphernalia.

DESCRIPTION OF THE PREFERRED EMBODIMENT

The carton of the invention described in this application is well known in the packaging industry as the Houghland or snap lock bottom carton. It is frequently known as the 1-2-3 closure because of the swift and speedy manner in which the bottom panels may be erected. The other outstanding feature of this closure is that once the bottom of the carton has been assembled, the carton and bottom are quite stable and not subject to collapse.

Figure 1:
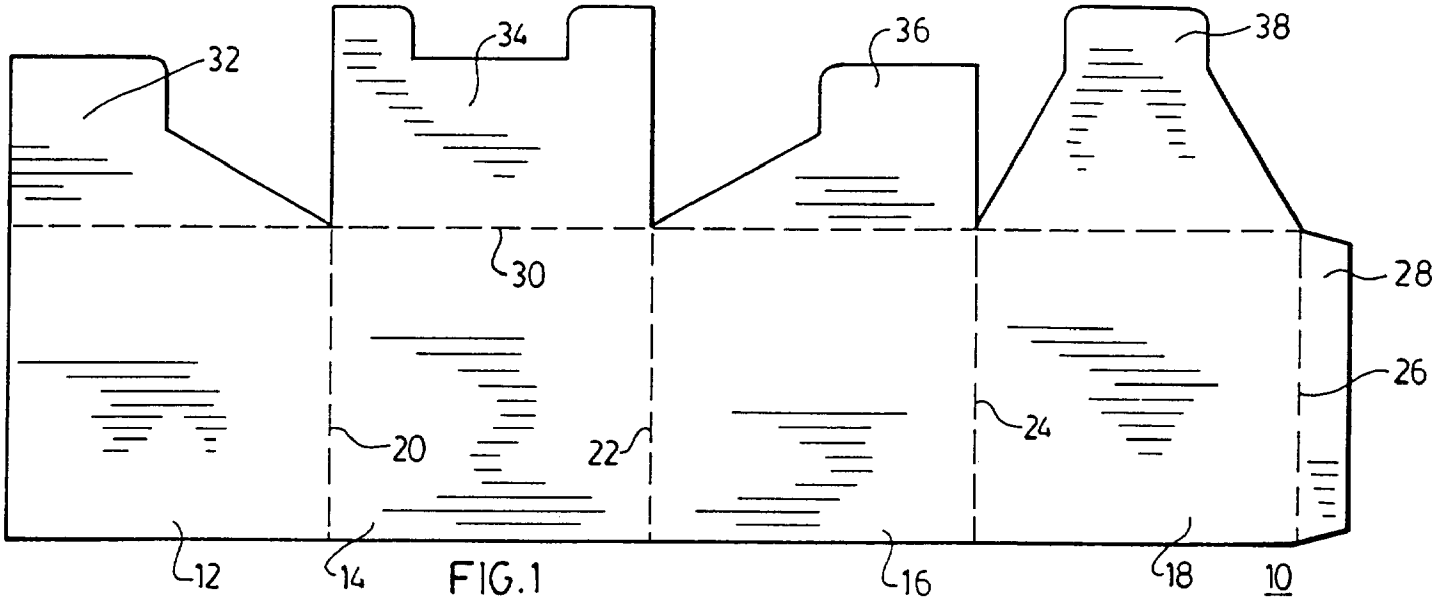
FIG. 1 is a drawing of the blank used to form the box of this invention.

Referring now to FIG. 1 a blank 10 is shown having four panels 12, 14, 16, 18 (which become the sidewalls of the container 10) separated by score lines 20, 22, 24, 26. Score line 26 separates glue flap 28 from panel 18.

Figure 2:
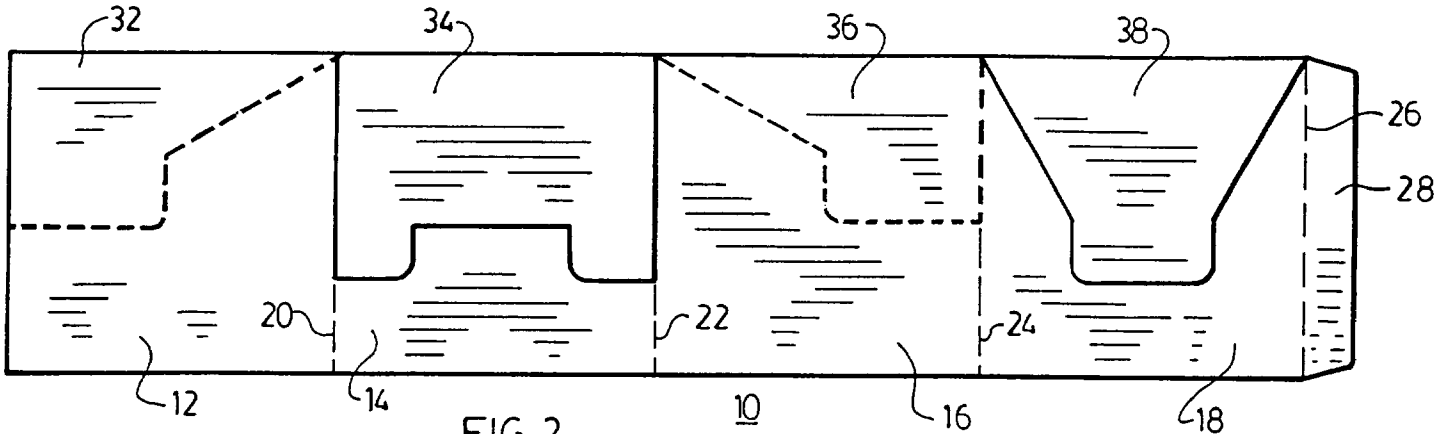
FIG. 2 is shows the blank of FIG. 1 in a partially folded condition.

A second score line 30 is provided between panels 12, 14, 16, 18 and end panel components 32, 34, 36 and 38 respectively. The end panel components 32 and 36 are bent inwardly of the sides 12 and 16 before or after glue flap 28 is glued to side 12. End flaps 34 and 38 are bent outwardly of panels 14 and 18 so as to overlie the exterior surface of panels 14 and 18 as shown in FIG. 2.

Figure 3:
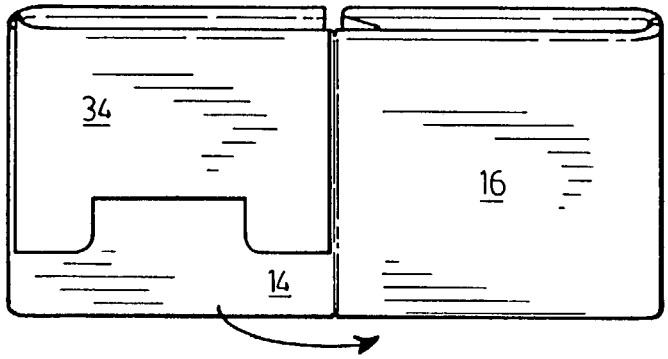
FIG. 3 shows the partially folded box blank of FIG. 1.

Flap 28 is next glued to the side 12. With the glue flap 28 secured to side 12 and the end panels 32 and 36 tucked inside the carton and end panels 34 and 36 folded over the outside of panels 14 and 18, the folded blank 10 takes on the appearance of a flat folded structure of FIG. 3. The box may be folded again at scorelines 20 and 22 to produce the folded box as shown in FIG. 4.

Figure 4:
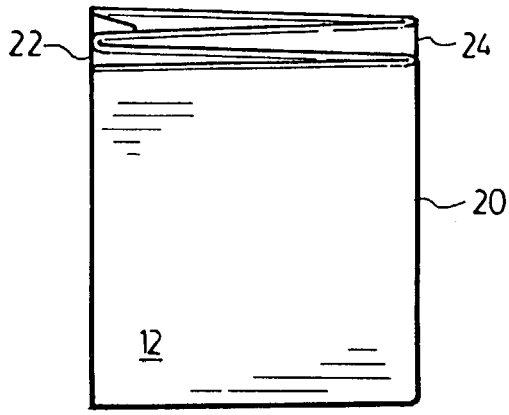
FIG. 4 shows the box of FIG. 1 completely folded.
Figure 5:
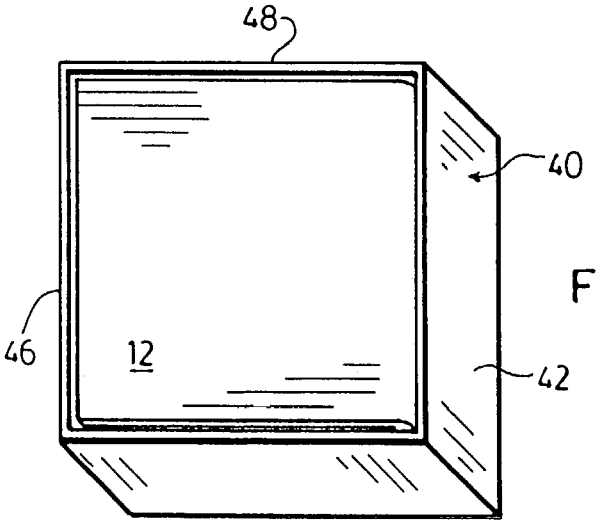
FIG. 5 shows the folded box of FIG. 4 inserted into the box lid.
Figure 6:
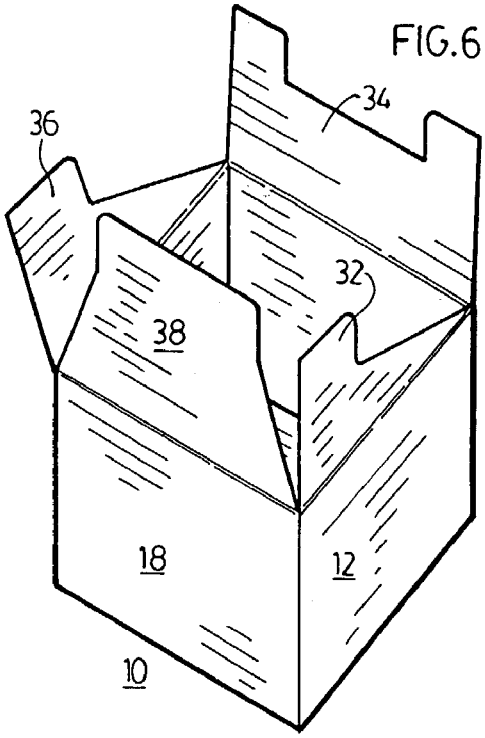
FIG. 6 shows box 10 oriented for construction of the bottom
Figure 7:
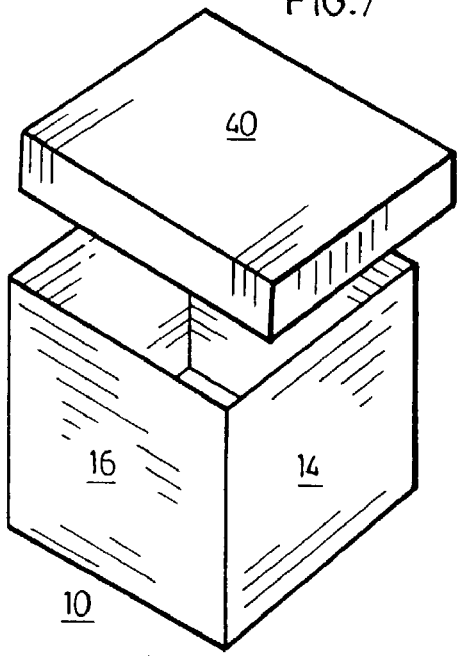
FIG. 7 shows the box having the lid placed thereon.

The folded box of FIG. 4 may now be inserted in lid 40 as shown in FIG. 5. Lid 40 is a rigid lid having shallow sides 42, 44, 46 and 48 to embrace and overlap box 10 when assembled. The box 10 and lid 14 require only as much space as the lid represents; in this condition the box and lid present a very compact unit for shipping and storage. A ribbon 52 and any other decorative paraphernalia such as gift tag 50 may be included in the box lid under the protection of a shrink-wrap.

Figure 8:
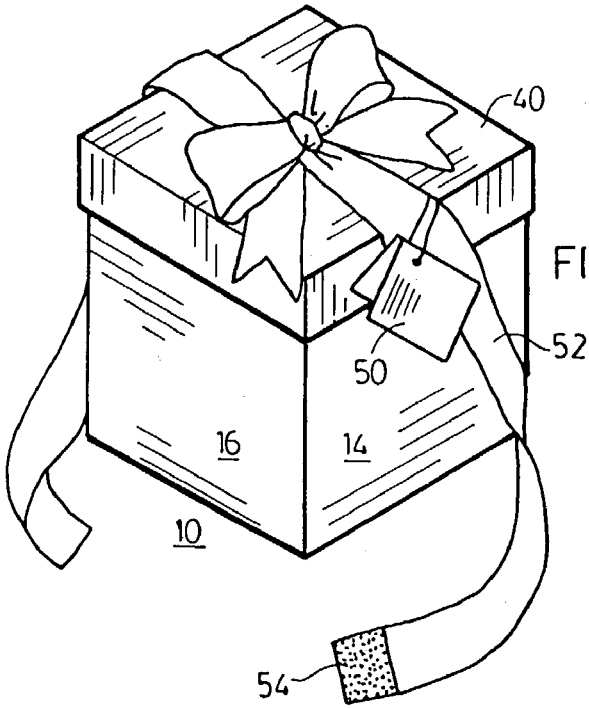
FIG. 8 shows the complete box having a ribbon applied.
Figure 9:
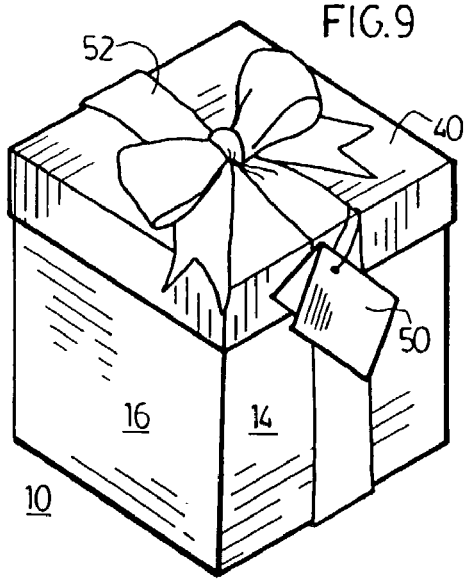
FIG. 9 shows the completely assembled box with a decorative ribbon in place.

It will be noted that the ribbon 52 shown in FIG. 8 is preglued at 54 to provide a complete seal for box 10. The ribbon 52 shown in FIG. 9 is securely fastened to the box 10 by means of preglued portion 54 to hold the lid closed and to secure the gift tag 50 in its proper place.

The gift box described above may be conveniently stored and assembled in a jiffy. It may be attractively appointed and used for a variety of occasions.

The enclosing wrap which secures the unassembled carton within the carton lid may be a transparent shrink wrap or it may be a plastic bag which surrounds the lid and unassembled carton. These materials may be transparent or semi transparent. It is envisioned that plastic or nylon enclosures may perform equally well.

The material comprising the box may be Kraft board, wood, plastic sheeting or sheet metal, such as aluminum or steel.

What is claimed:

1. In combination:

(a) a lid further comprising a lid panel, and four lid sides extending generally perpendicularly from the lid panel and being fastened at adjoining end edges thereof, wherein the lid panel is dimensioned such that a space inside the lid has a lid width and a lid length, and the four lid sides are dimensioned such that the space inside the lid has a lid depth; and (b) a folded blank further comprising four main panels each having rectangular panel dimensions such that the folded blank fits, in the space inside the lid, within the lid width and the lid length, and additional panels folded onto the main panels, and wherein the main panels and the additional panels are folded together such that the folded blank fits, into the space inside the lid, within the lid depth, whereby the blank is embraced and overlapped by the lid;

(c) wherein the folded blank is unfoldable and erectable into a box consisting of four sides each comprising one of the main panels, a bottom comprising the additional panels, and an open top coverable by the lid.

2. The combination according to claim 1, wherein the lid panel and the main panels of the blank are substantially square, whereby an assembly of the box and the lid is substantially cubical.

3. The combination according to claim 1, wherein the additional panels include four bottom panels which when assembled interlock to form the bottom of the box, and wherein each of the four bottom panels is attached to a respective one of the mains panels forming the four sides of the assembled box.

4. The combination according to claim 3, wherein the four bottom panels form a Houghland bottom for the box.

5. The combination according to claim 1, comprising wrapping paraphernalia disposed in the space inside the lid.

6. The combination according to claim 5, wherein the wrapping paraphernalia comprises ribbon and/or a gift tag.

7. The combination according to claim 6, comprising transparent wrap enclosing the lid, the folded blank, and the wrapping paraphernalia.

8. The combination according to claim 6, comprising a closely fitting bag of a translucent plastic material enclosing the lid, the folded blank, and the wrapping paraphernalia.

9. A gift carton comprising a rigid lid defining a space inside the lid, an unassembled gift carton contained, in an unassembled condition, within the space inside the lid, wrapping paraphernalia within the space inside the lid, and transparent shrink wrap enclosing the lid, the carton, and the wrapping paraphernalia.

10. The gift carton as in claim 9, wherein the wrapping paraphernalia comprises at least one of ribbons, bows, and tags.

* * * * *